US005860697A

United States Patent [19]

Fewchuk

[11] Patent Number: 5,860,697

[45] Date of Patent: Jan. 19, 1999

[54] SCHOOL CHAIR

[75] Inventor: Michael Andrew Fewchuk, Eastwood, Australia

[73] Assignee: Sebel Furniture Limited, New South Wales, Australia

[21] Appl. No.: 959,710

[22] Filed: Oct. 28, 1997

Related U.S. Application Data

[63] Continuation of Ser. No. 670,727, Jun. 21, 1996, abandoned.

[30] Foreign Application Priority Data

Jun. 23, 1995 [AU] Australia ..... PN3769

[51] Int. Cl.[6] ..... A47C 3/04

[52] U.S. Cl. ..... 297/239; 297/188.04; 297/DIG. 2

[58] Field of Search ..... 297/239, DIG. 2, 297/451.12, 451.13, 451.11, 448.1, 452.2, 181, 188.01, 188.04; 40/320

[56] References Cited

U.S. PATENT DOCUMENTS

| | | | |
|---|---|---|---|
| 2,626,653 | 1/1953 | VanWyck | 40/320 X |
| 3,848,925 | 11/1974 | Harder, Jr. . | |
| 3,873,154 | 3/1975 | Baker, Jr. . | |
| 4,183,154 | 1/1980 | Dykes | 297/440.18 X |
| 4,230,364 | 10/1980 | Parker | 297/452.13 X |
| 4,291,917 | 9/1981 | Hawks . | |
| 4,586,747 | 5/1986 | Taylor . | |
| 4,676,552 | 6/1987 | Hiller . | |
| 4,749,232 | 6/1988 | Guichon | 297/239 X |
| 4,906,046 | 3/1990 | Kleinklaus | 297/239 X |
| 5,356,204 | 10/1994 | McDonough | 297/181 X |
| 5,509,720 | 4/1996 | Croom | 297/181 X |
| 5,678,892 | 10/1997 | Heitlinger | 297/239 X |

OTHER PUBLICATIONS

Search Report dated 25 Sep. 1996 with respect to the corresponding UK patent application, citing the documents noted above (1 page).

*Primary Examiner*—Milton Nelson, Jr.
*Attorney, Agent, or Firm*—Merchant, Gould, Smith, Edell, Welter & Schmidt, P.A.

[57] ABSTRACT

A moulded plastic chair (1) fabricated using an air mould technique with four substaitially identical legs (4, 5) which are hollow, have a constant cross-section along their length and have a leading convex edge (13) and a rearward concave edge (14). The shape and arrangement of the legs (4, 5) constitutes a stacking mechanism which enables like chairs to be conveniently stacked. A indicator (8) able to indicate the size of the chair (1) is also disclosed as is a pair of protrusions (8) on the upper edge (7) of the backrest (3), the protrusions (8) providing a support for a school bag (10).

9 Claims, 2 Drawing Sheets

SCHOOL CHAIR

This is a File Wrapper Continuation of application Ser. No. 08/670,727, filed Jun. 21, 1996, now abandoned.

BACKGROUND OF THE INVENTION

1. Field of the Invention

The present invention relates to chairs and, in particular, to school chairs suitable for use by school children of all ages.

2. Description of the Prior Art

A number of demands are placed on school chairs which are not placed on chairs intended for other uses, for example in the home or in the office, In particular, school chairs must be robust since school children are liable (when unsupervised) to stand on the chairs or otherwise mistreat them. In addition, for reasons of space and the cleaning of school rooms, it is necessary mtat the school chairs be stackable. The stacking nechnism should be both simple and robust.

During the years of school attendance prior to adulthood, a person's stature is directly correlated to their age and for this reason school chairs are normally made in a range of sizes, the smallest size being intended for use by th youngest and smallest children, and the largest size being intended for use by te oldest and largest children who are, essentially, of adult statures.

School chairs should also support the substantial range of sizes of children occurrig within a particular class in postures which are beneficial for their activities. Within any class, and in particular within those classes including children at different stages of their growth spurt around puberty, there will be some students who are quite short and some students who are quite tall. Accordingly, the seating requirements of these students are different. In order not to make such students feel as if they were "the odd child out" it is desirable that these students be provided with an appropriately sized chair which is provided with a subtle indication of size sufficiently unobtrusive so as to not embarrass the student.

Furthermore, in relation to the classroom generally, there is a need for students to store their school bags in a storage arrangement such that the bags do not block the aisles or rows between the seats and are preferably easily accessible by the children in order to remove an item from the contents of the bag, or place an item into the interior of the bag.

The present invention seeks to meet the above mentioned desirable characteristics to a maximum extent possible, while also seeking to overcome, or ameliorate, to at least some extent the above mentioned disadvantages.

SUMMARY OF THE INVENTION

In accordance with a first aspect of the present invention tere is disclosed a stacking mechanism for a chair having four legs two of which are substantially located in each of two planes positioned one to each side of the chair, said two legs each comprising a rearwardly inclined forward leg and a forwardly inclined rear leg wherein said stacking mechanism comprises a convex surface extending along the front of said forward legs and the rear of said rear legs and a concave surface extending along the rear of said forward legs and the front of said rear legs, said chair being able to be stacked with a like chair with said convex surfaces of the lower chair abutting the concave surfaces of the upper chair to thereby locate said upper chair on said lower chair.

Preferably all four legs are substantially identical in cross-sectional profile and of substantially constant cross-sectional shape along their length.

In accordance with a second aspect of the present invention there is disclosed a colour coding scheme for a set of school chairs in which at least one of the chairs is fabricated to a first size to suit a child of a first stature and at least one of the chairs is fabricated to a second size to suit a child of a second stature, all said chairs being fabricated substantially alike and having an unobtrusive indicium portion, each of said indicium portions of the chairs of said first size being alike and being different from each of the alike indicium portions of the chairs of said second size.

In accordance with a third aspect of the present invention there is disclosed a school bag securing mechanism for a school chair having legs, a seat and a backrest, said mechanism comprising at least one protrusion extending from the upper edge of said backrest, said protrusion being shaped to engage a looped portion of said school bag.

Preferably the backrest has two of the protrusions each located adjacent a corresponding side of the backrest to provide engagement with a loop or shoulder strap of a school bag positioned to either side of the chair.

In accordance with a fourth aspect of the present invention a set of school chairs having the above mentioned colour coding scheme is also disclosed.

Preferably the indicium portions are visible both from the front and rear of the chairs. Most desirably the indicium portions take the form of the above mentioned school bag supporting protrusions.

In accordance with a fifth aspect of the present invention there is disclosed a set of chairs each having the above-mentioned preferred stacking mechanism, the members of each set baving substantially the same seat and backrest but legs selected from a predetermined number of predetermined leg lengths, the seat and backrest of the different sets being of substantially identical appearance but of different scale, whereby the chairs of any one set stack in intermingled fashion with each other, irrespective of leg length.

BRIEF DESCRIPTION OF THE DRAWINGS

A preferred embodiment of the present invention will now be described with reference to drawings in which.

DESCRIPTION OF THE PREFFERED EMBODIMENT

Figure 4:
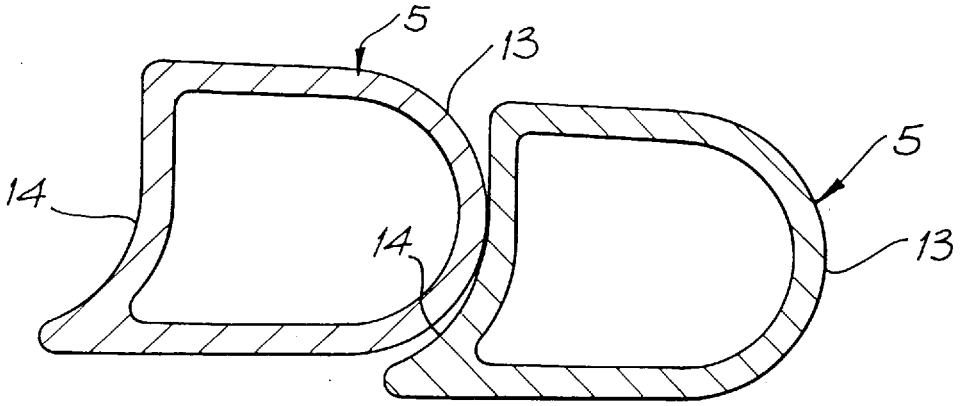
FIG. 4 is a cross sectional view taken along the line 4—4 of FIG. 3.

The chair 1 of the preferred embodiment is provided with a seat 2, a backrest 3, front legs 4 and rear legs 5. The chair 1 is preferably injection moulded from polypropylene or like plastics material utilising an air mould technique. Thus the chair 1 is essentially integrally formed with the seat 2, backrest 3 and legs 4, 5 all being moulded in the one process. As indicated in FIG. 4, the legs 4, 5 are hollow.

Figure 3:
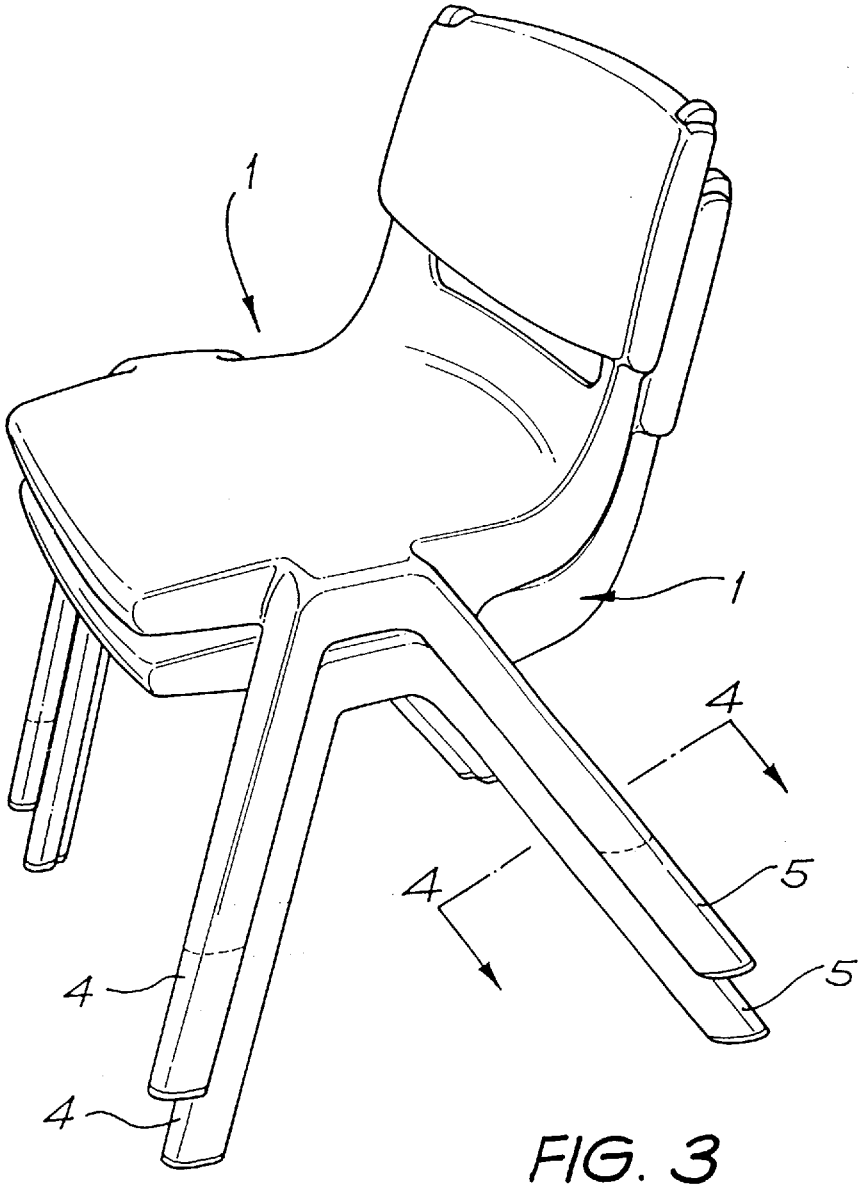
FIG. 3 is a view similar to FIG. 1 but showing two like chairs stacked one upon the other.

This has the advantage of providing appropriate strength and stiffess in the legs while also reducing the weight of the chair and the consumption of raw material. Since the location of line 4—4 in FIG. 3 is essentially arbitrary as to location along the legs or selection of leg, it will be apparent that the legs 4, 5 are essentially of constant cross-sectional along their length and of essentially identical cross-sectional profile in that left legs are mirror images of the corresponding right legs and rear legs are mirror images of the corresponding front legs.

As is well known, the chairs 1 can be fabricated to a variety of sizes to suit the expected range of stature of school children with the smallest chairs being fabricated for those children of the smallest stature, and the largest chairs being fabricated for those children having essentially adult statures.

For many classes having children with a range of statures, it is necessary within the single class to have, for example, two sizes of chair. This is necessary in order to meet the desired need that each child sit on a chair which is ergonomically best suited for that child.

Thus within a single classroom there can be, for example, a number of an appropriate size of chair for those children having the smallest to average stature, and the remainder of the chairs are of the next largest size for average to largest statured pupils in the class.

However, within a single school, particularly one offering education over a large number of years there can be, for example, very small chairs for those children having the smallest stature (typically because they have not yet experienced a growth spurt), average size chairs for those children of intermediate size, and chairs of relatively large size for the pupils who are of above average size and who have already experienced a substantial growth spurt.

Since many pupils of either small or large stature can be sensitive of this fact which, in their eyes, differentiates them from their fellows, it is desirable that the different sizes of chairs be as much alike as possible but that the teacher, in particular, be able to easily visually confirm that each child is sitting in a chair of the most appropriate size.

In the past such different size chairs have been moulded from different coloured plastics material. Thus, for example, the smallest children in a school sat on a red chair, the bulk of the children in the school sat on a green chair, whilst the largest children in the school sat on a yellow chair. Whilst this arrangement achieved the desired distribution of seat sizes, many of the children who were obliged to sit on a non-average size chair felt self conscious about this.

In order to overcome this problem the chair of the preferred embodiment is moulded in all sizes from the same coloured material. However, the backrest 3 along its upper edge 7 is provided with two protrusions 8 which are coloured and which are spaced apart at the outer extremities of the top edge of the backrest. The coloured protrusions 8 can be adhered, ultrasonically welded, or in some other way attached to the backrest 3 after the moulding process.

If the chairs 1 are all moulded from, say, green material then the protrusions 8 can be respectively blue and orange to indicate smaller and larger chairs, or red, white and yellow to indicate small, medium and large chairs respectively. In this connection it will be appreciated that the protrusions 8 constitute a very unobtrusive indicia and thus those children which are requested to sit on large or small chairs do not feel unduly embarrassed or inconvenienced by this request. As a consequence it is anticipated that compliance with correct chair sizes will be substantially increased.

Figure 1:
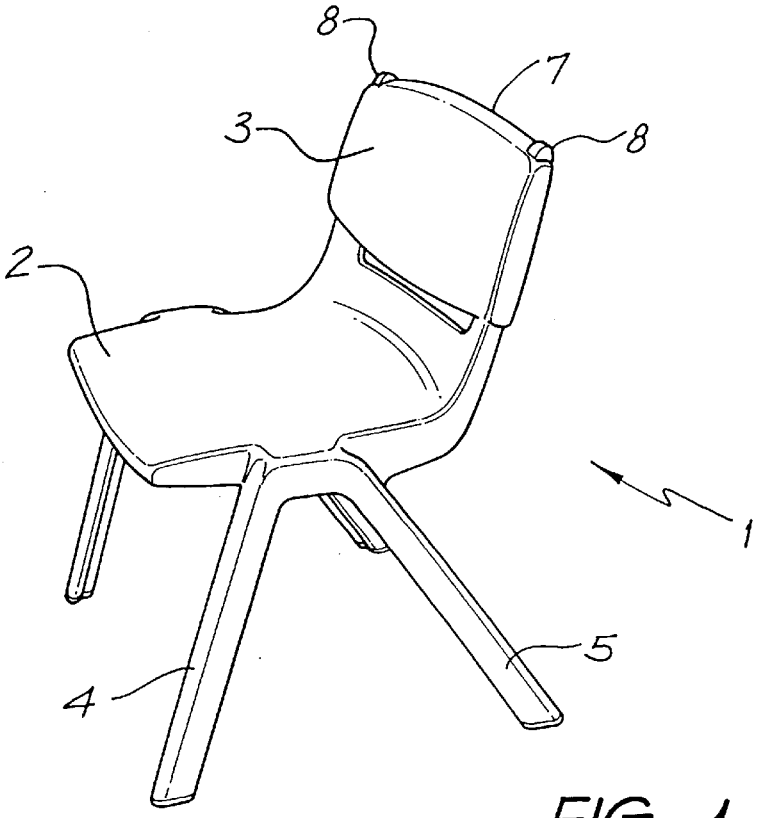
FIG. 1 is a left side perspective view from the front of the chair of the preferred embodiment.
Figure 2:
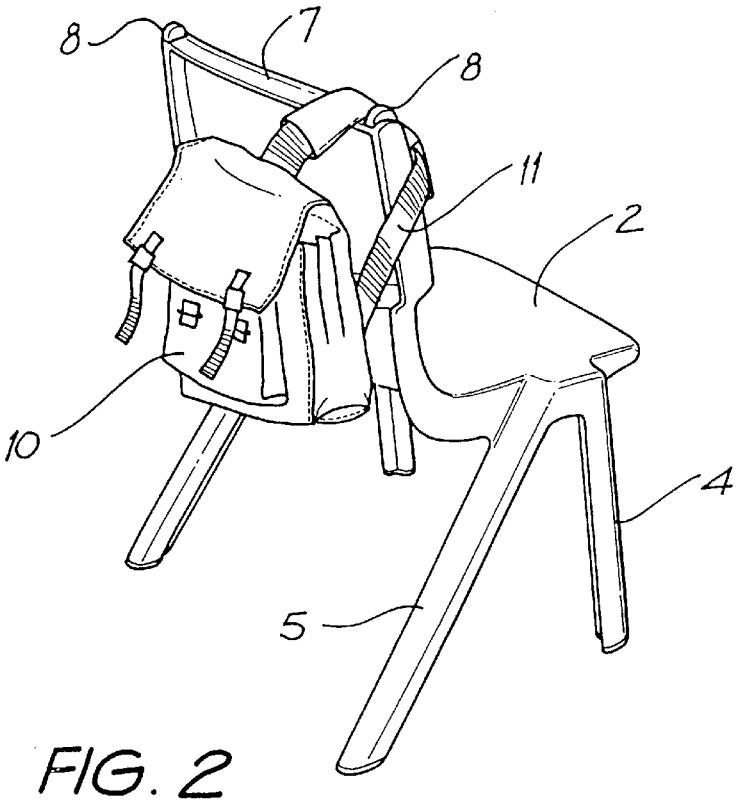
FIG. 2 is a right side perspective view from the rear of the chair of FIG. 1 showing how a school bag can be supported by the chair.

As seen in FIG. 2, the protrusions 8 preferably form a dual purpose in that each of the protrusions constitutes a hook or knob from which a school bag 10 can be suspended or hung. In FIG. 2 the school bag 10 is of a satchel or rucksack style having a pair of shoulder straps 11. As illustrated one of the shoulder straps 11 can be passed over the upper edge 7 of the backrest 3 and retained in position by engagement with the corresponding protrusion 8.

Irrespective of which protrusion 8 is engaged by school bag 10, it will be appreciated that the school bag is not obstructing aisles (not illustrated) between adjacent rows of chairs by lying on the floor. It this way the classroom is easily provided with an uncluttered appearance and the chance of children tripping over is reduced. Also the bag is located in an easily accessible position so that items may be removed from its interior or added to its contents.

Turning now to FIGS. 3 and 4, it wil be seen that two like chairs 1 can be stacked one above the other. In this connection each of the legs 4, 5 is preferably provided with an identical cross-sectional profile having a leading convex edge 13 and a rearward concave edge 14 as best seen in FIG. 4. When the two chairs are stacked as illustrated in FIG. 3 then the convex edge of the legs of the lower chair mate with the concave edge of the legs of the upper chair. This mating locates the chairs in stacked arrangement and enables a substantial number of chairs to be positioned one above the other within a single stack of chairs. This locating arises because of the inter-engagement of the convex and concave edges 13, 14 along the length of the legs and the facing of these edges in opposite directions.

The chairs are preferably made in three sets. The "adult" size set has a full size seat and backrest and fall length legs so that the height of the upper surface of the seat above the floor is 445 mm. The other member of the "adult" set may be termed the "mini-adult" and has the same size scat and backrest but has shorter legs so that the height of the upper surface of the seat above the floor is 405 mm.

The next set may be termed "adolescent" and has a seat and backrest scaled down in size to be ⅞ths of the adult. The two members of this set have seat heights of 395 and 350 mm respectively for the "adolescent" and "mini-adolescent".

The third set may be termed "junior" and has a seat and backrest scaled down in size to be ¾ths of the adult. The two members of is set have sear heights of 335 and 295 mm respectively for the "junior" and "mini-junior".

In FIG. 3, by means of dashed lines, the legs of a mini-member of one of the sets are illustrated. Thus the two members of each set stack one on the other, in either order because not only are the seat and backrest the same size but the stacking mechanism of the legs is independent of leg length. This ability to stack different members of the same "set" in any order within the one stack of cars provides an important advantage in saving space. Further, the fact that different sized chairs having differently coloured indicia 8 can be stacked within the one stack fliner reduces the feeling of social distinction between individuals who, because of their size difference, should be seated on seats of different height above the floor.

A further advantage of the above described chair is that the seat has a sloping front to facilitate a more open angle between the sitter's trunk and thighs. This is achieved without there being unduly concentrated pressure under the thighs.

The foregoing describes only one embodiment of the present invention and modifications, obvious to those skilled in the art, can be made thereto without departing from the scope of the present invention.

I claim:

1. A multiplicity of sets of chairs, each of said sets comprising a plurality of chairs, each of the chairs of said set having substantially same sized and shaped seat and backrest but legs selected from a predetermined number of predetermined leg lengths, said chairs of each of the sets being stacked in intermingled fashion with each other irrespective of leg length, said intermingled fashion being of random order, wherein the seat and backrest of one of said chairs in one said set of the multiplicity of said sets are of substantially identical appearance but of different size to said chairs in other of said sets of the multiplicity of said sets.

2. A multiplicity of sets of chairs as claimed in claim 1, wherein each said chair includes an unobtrusive indicium portion indicative of a size of the chair.

3. A multiplicity of sets of chairs as claimed in claim 2, wherein said indicium portion is colored to provide unobtrusive indicia indicative of the size of the chair.

4. A multiplicity of sets of chairs as claimed in claim 2, wherein the indicium portion is at least one protrusion extending from an upper edge of said backrest of said chair, said protrusion being shaped to engage a looped portion of a school bag.

5. A multiplicity of sets of chairs as claimed in claim 2, wherein each said chair includes a pair of protrusions spaced apart and located adjacent opposite sides of said chair.

6. A set of chairs comprising a plurality of chairs, each of the chairs of said set having substantially same sized and shaped seat and backrest but legs selected from a predetermined number of predetermined leg lengths, said chairs of said set being stacked in intermingled fashion with each other irrespective of leg length, said intermingled fashion being of random order, wherein each said chair having four legs, two of which are substantially located in each of two planes positioned one to each side of said chair, said two legs each comprising a rearwardly inclined forward leg and a forwardly inclined rear leg, said chair further including a stacking mechanism comprising a convex surface extending along a front of said forward legs and a rear of said rear legs and a concave surface extending along a rear of said forward legs and a front of said rear legs, said chair being able to be stacked with a like said chair with said convex surface of a lower chair abutting the concave surface of an upper chair to thereby locate said upper chair on said lower chair.

7. A set of chairs as claimed in claim 6, wherein all four legs are substantially identical in cross-sectional profile.

8. A set of chairs as claimed in claim 7, wherein each said leg has a substantially constant cross-sectional shape along its length and whereby said stacking mechanism is independent of the length of each leg.

9. A set of chairs as claimed in claim 8, wherein each said leg is substantially hollow being molded from plastics material using an air mold technique.

* * * * *